US006802621B2

(12) United States Patent
Adeler

(10) Patent No.: US 6,802,621 B2
(45) Date of Patent: Oct. 12, 2004

(54) LAMP

(75) Inventor: Kjell Adeler, Calle Acoran (ES)

(73) Assignee: Grabit AS, Risor (NO)

( * ) Notice: Subject to any disclaimer, the term of this patent is extended or adjusted under 35 U.S.C. 154(b) by 0 days.

(21) Appl. No.: 10/297,392

(22) PCT Filed: Jun. 20, 2001

(86) PCT No.: PCT/NO01/00260

§ 371 (c)(1),
(2), (4) Date: Dec. 6, 2002

(87) PCT Pub. No.: WO02/10639

PCT Pub. Date: Feb. 7, 2002

(65) Prior Publication Data

US 2003/0133289 A1 Jul. 17, 2003

(30) Foreign Application Priority Data

Jun. 20, 2000 (NO) ..... 2000-3188

(51) Int. Cl.[7] ..... F21L 4/00

(52) U.S. Cl. ..... 362/157; 362/189; 362/183; 362/206; 362/208; 362/800

(58) Field of Search ..... 362/157, 189, 362/183, 204, 205, 202, 206, 208, 800, 200

(56) References Cited

U.S. PATENT DOCUMENTS 1,067,646 A * 7/1913 Downey ..... 362/157
1,200,366 A * 10/1916 Kerlin ..... 362/189
1,392,163 A * 9/1921 Hoffmann ..... 362/200
2,197,372 A * 4/1940 Bailey ..... 43/17.6
2,561,532 A * 7/1951 Muir ..... 362/189
3,162,376 A 12/1964 Syoichi
3,790,912 A 2/1974 Murphy
3,809,882 A * 5/1974 Wetmore ..... 362/186
3,898,450 A 8/1975 Kilby
4,303,970 A 12/1981 Robertson
4,433,364 A * 2/1984 Noble ..... 482/8
4,760,504 A 7/1988 Schaller et al.
5,490,050 A * 2/1996 Clark et al. ..... 362/263

FOREIGN PATENT DOCUMENTS

GB 2 089 015 A 6/1982
GB 2 090 956 A 7/1982

* cited by examiner

*Primary Examiner*—Stephen Husar
*Assistant Examiner*—Sharon Payne
(74) *Attorney, Agent, or Firm*—Young & Thompson

(57) ABSTRACT

A lamp comprises a light source (1), a battery (2) and a switch unit (3) which are electrically interconnected. The lamp's reliability, wear life and corrosion resistance are increased by the switch unit being a magnetic switch (3), which by an electrically insulating moulding material is moulded in the same unit as the light source (1) and the battery (2), and which is operated externally by a movable magnet (4).

13 Claims, 3 Drawing Sheets

LAMP

The invention relates to a battery-powered lamp, and especially a lamp comprising a light source, a battery and a switch unit which are electrically interconnected.

In more specific terms, the invention relates to disposable lamps for general use. The lamps are hand-held lamps, both chargeable and non-chargeable, and of different sizes.

Ordinary lamps, particularly lamps containing replaceable batteries, light sources or other components, all have in common the problem that they corrode easily and are unreliable over a period of time. This is usually due to the penetration of moisture, resulting in corrosion of contacts between batteries, light source and switch. A result of this corrosion is that the lamp has to be shaken and knocked in order to make it work.

U.S. Pat. No. 4,303,970 discloses a lamp of the type mentioned at the beginning, which is made watertight by means of a sealed housing. The lamp also contains an elastic material, such as foam rubber. The material provides electrical and thermal insulation, but contains air, thus leading amongst other things to the risk of condensation being formed inside the lamp. Optimal protection is therefore not obtained against the formation of corrosion in the electrical connections. The lamp contains a mechanical switch which is operated from the outside via sealing means around a control spindle. This represents an additional risk of penetration of air, water and vapour and of the formation of corrosion.

An object of the invention is to provide a lamp as mentioned at the beginning, which is reliable, resistant in most environments, watertight, corrosion-resistant, robust, possessing long storage durability, resistant to impact, shock and other physical stresses, and having low production costs.

A special object of the invention is to provide a lamp of this kind which can also be operated from outside by an operating body, where the operating body, does not detract from qualities in the lamp such as reliability, resistance, watertightness, corrosion resistance, robustness and storage durability.

A further object is to provide a lamp of this kind which in addition is environmentally friendly, and/or a lamp of this kind which can be included in a return scheme.

The above objects are achieved by means of a lamp as set forth in the patent claims.

Figure 1:
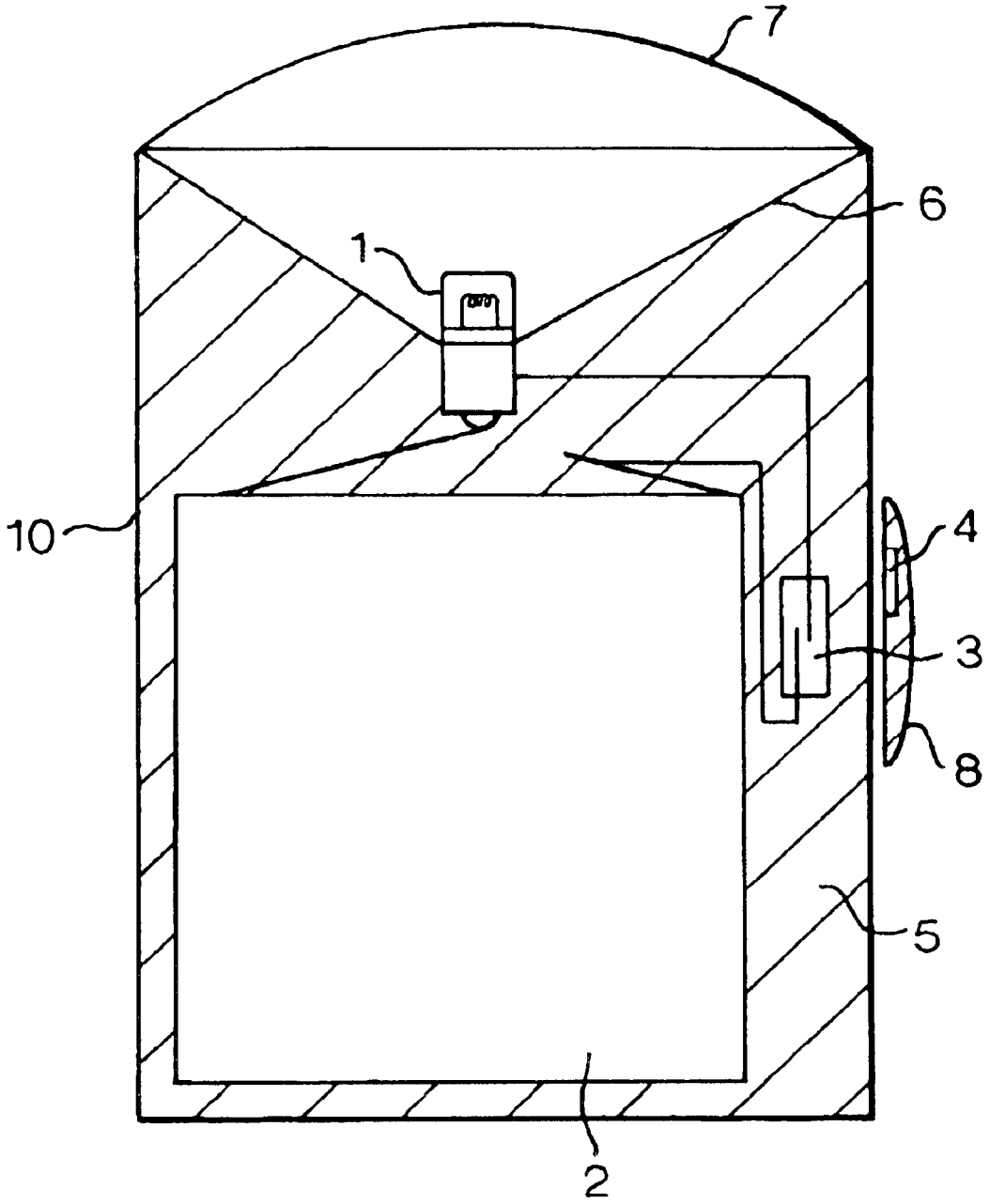
Figure 2:
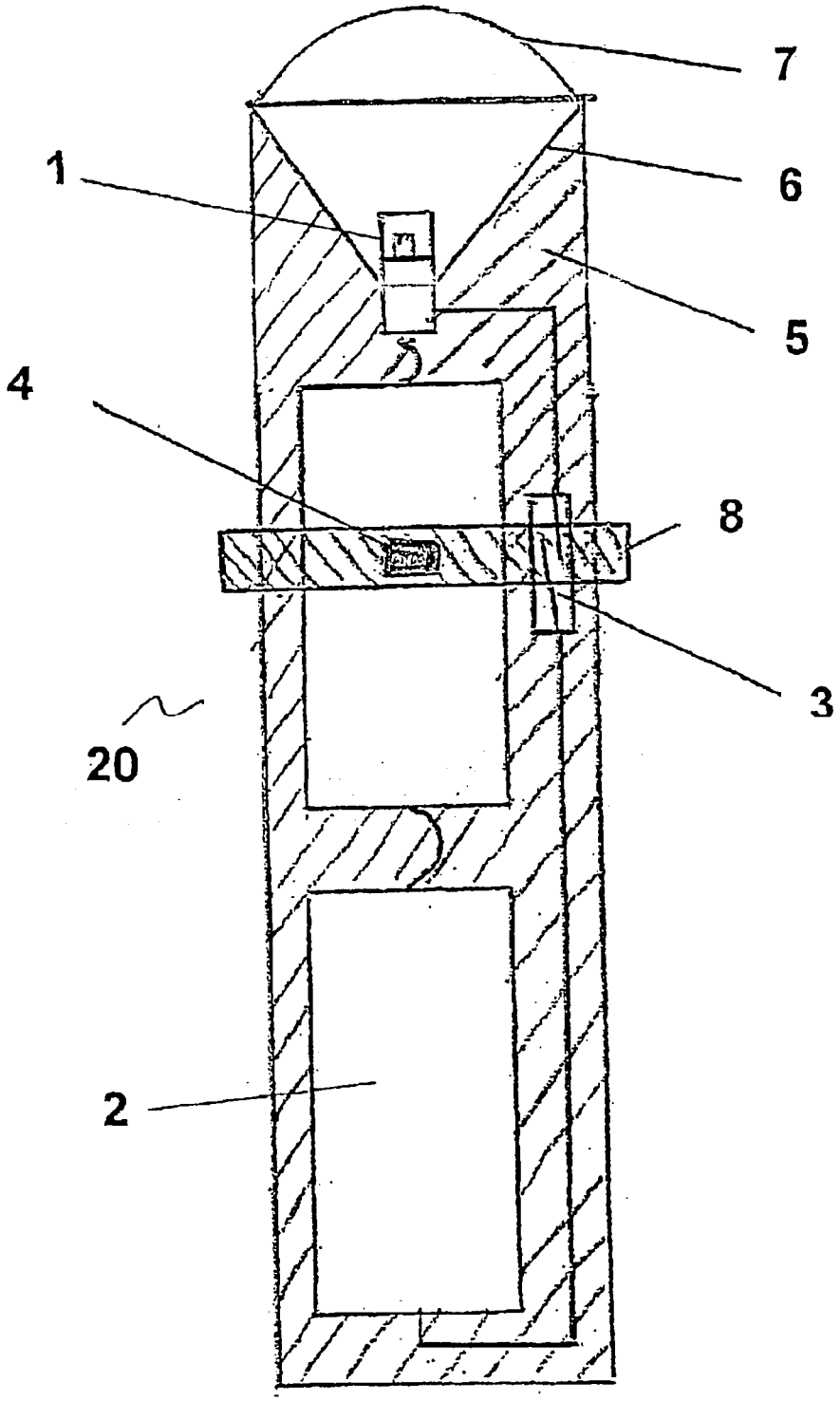
Figure 3:
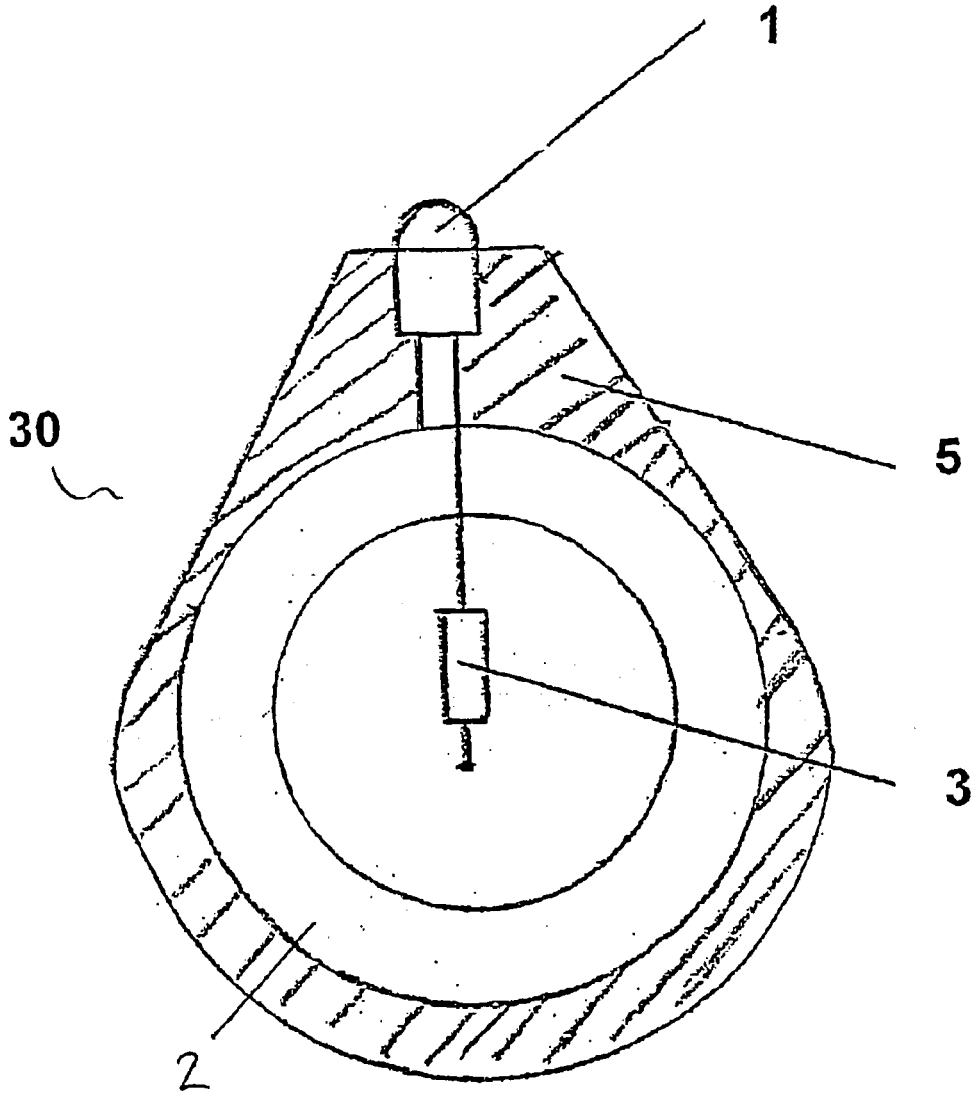

The invention will now be described in greater detail with reference to the drawings, in which:

FIG. 1 is a schematic cross section of a first embodiment of a lamp according to the invention, FIG. 2 is a schematic cross section of a first section embodiment of a lamp according to the invention, and FIG. 3 is a schematic view from above of a third embodiment of a lamp according to the invention.

FIG. 1 illustrates a cross section of a first embodiment of a substantially rectangular lamp according to the invention. The lamp 10 consists of a light source 1, a battery 2 and a switch unit 3 which are electrically interconnected. All electrical connection points are preferably welded or soldered, thus reducing the risk of corrosion.

The light source 1 is illustrated as an incandescent lamp, but may alternatively be one or more interconnected high intensity light diodes, connected in series with a current limiting pre-resistor which may be integrated in the light diode.

All the electrical connections are located in a corrosion-free environment. This is achieved by having the light source 1, the battery 2 and the switch unit 3 all moulded in an electrically insulating moulding material, without the presence of air and/or moisture.

A suitable moulding material is polyethylene. Other examples of suitable moulding materials are polycarbonate, epoxy, polystyrene, silicone and two-component or multi-component plastic materials.

The switch unit 3 is a sealed magnetic switch or "reed switch". The switch unit 3 is operated externally by an operating body 8 which contains a movable permanent magnet 4. An electrical connection is formed between the switch's two terminals when a magnetic field of sufficient force is created through the switch unit, such as when the magnet 4 is located in the immediate vicinity. In this embodiment the operating body is movably mounted on the outside of the lamp by means of slots or guides on the outside of the lamp's moulded main part.

The lamp also comprises a reflector 6 and a lamp lens 7, both of which are moulded in the same unit as the light source 1, the battery 2 and the switch unit 3.

FIG. 2 illustrates in cross section a second embodiment 20 of a substantially cylindrical lamp according to the invention. Identical or corresponding elements are given the same reference numerals as in FIG. 1. The battery 2 in this case consists of two cylindrical cells, connected in series.

This embodiment 20 corresponds by and large with the embodiment 10 in FIG. 1, except for the fact that the movable magnet 4 is attached to a circular ring 8 which is arranged to be rotated round the lamp. The ring 8 has an internal diameter which is slightly larger than the external diameter of the main part of the lamp, thus permitting rotation with a suitable degree of friction. When the ring 8 is rotated to a position where the magnet is located immediately above the magnetic switch 3, the lamp will be switched on. The main part of the lamp is provided with slots (not shown) which are suitable for holding the ring in a fixed axial position while permitting rotating movement.

In a variant of the embodiment in FIG. 2, the ring 8 is arranged to be moved in a spiral, i.e. with a rotating movement with a simultaneous movement in the lamp's axial direction. This can be achieved by providing the ring with an internal spiral-shaped slot, adapted to fit a fixed raised portion on the outside of the lamp's main part.

FIG. 3 is a schematic view from above of a third embodiment 30 of a miniaturised lamp according to the invention. In this case a button cell is employed for the battery 2, and for the light source 1 a light-emitting diode with integrated pre-resistor. The magnetic switch 3 is operated by a movable operating body (not shown) on the outside of the lamp's moulded main part and containing a magnet (not shown).

In contrast to known lamps which are made watertight solely by means of a tightly enclosing housing, the chances of the formation of corrosion are greatly reduced in the lamp according to the invention, since the moulding material fills all the cavities, thus preventing air, vapour or water from coming into contact with the electrical connection points. This feature, combined with the use of a sealed magnetic switch and a movable magnet arranged for external operation, provide a highly reliable lamp with long storage durability. Furthermore, the lamp provided is extremely robust with regard to influences from external forces such as impacts and shocks, since the moulding material eliminates play and freedom of movement of the lamp's components.

It will be apparent to those skilled in the art that many modifications and variations are possible within the scope of the invention as it is defined by the following patent claims and by their equivalents.

What is claimed is:

1. A lamp device comprising a lamp device housing (5), a light source (1), battery means (2), and a magnetically operated switch unit (3) connected between the light source and the battery, said switch unit (3) being operable through use of magnetic means (4) movable relative to the exterior of the housing (5), wherein all electrical connections between said light source (1), said battery means (2) and said switch unit (3) are welded or soldered thereto, respectively, and wherein said battery means (2), said switch unit (3), said electrical connections, as well as non-radiating parts of the light source (1) are embedded in a cavity-free way in said housing, said housing being formed by an electrically insulating, unitary moulding material (5) to create a corrosion-free environment within the housing.

2. A lamp device according to claim 1, wherein said magnetic means is a magnet (4) attached to a ring member (8) which is movable about the circumference of the lamp housing.

3. A lamp device according to claim 1, wherein said magnetic means is a magnet (4) attached to a magnet holder (8) which is movable in a longitudinal direction of the lamp housing.

4. A lamp device according to claim 1, wherein said light source (1) includes a light reflector (6) and a lamp lens (7).

5. A lamp device according to claim 1, wherein the moulding material (5) is electable from the group of: polyethylene, polycarbonate, epoxy, polystyrene and silicone.

6. A lamp device according to claim 1, wherein the moulding material (5) is a two-component or multi-component plastic material.

7. A lamp device according to claim 2, wherein said light source (1) includes a light reflector (6) and a lamp lens (7).

8. A lamp device according to claim 3, wherein said light source (1) includes a light reflector (6) and a lamp lens (7).

9. A lamp device according to claim 4, wherein the moulding material (5) is electable from the group of: polyethylene, polycarbonate, epoxy, polystyrene and silicone.

10. A lamp device according to claim 7, wherein the moulding material (5) is electable from the group of: polyethylene, polycarbonate, epoxy, polystyrene and silicone.

11. A lamp device according to claim 8, wherein the moulding material (5) is electable from the group of: polyethylene, polycarbonate, epoxy, polystyrene and silicone.

12. A lamp device according to claim 4, wherein the moulding material (5) is a two-component or multi-component plastic material.

13. A lamp device according to claim 5, wherein the moulding material (5) is a two-component or multi-component plastic material.

* * * * *